US007445546B2

(12) United States Patent
Hondmann et al.

(10) Patent No.: US 7,445,546 B2
(45) Date of Patent: Nov. 4, 2008

(54) HOUSING FOR AN EXTRACTOR HOOD AND VENTILATOR HOUSING

(75) Inventors: Frank Hondmann, Bretten (DE); Jochen Krauter, Hildrizhausen (DE); Helmut Neuschl, Bretten (DE)

(73) Assignee: BSH Bosch und Slemens Hausgeraete GmbH, Munich (DE)

( * ) Notice: Subject to any disclaimer, the term of this patent is extended or adjusted under 35 U.S.C. 154(b) by 82 days.

(21) Appl. No.: 10/539,919

(22) PCT Filed: Dec. 5, 2003

(86) PCT No.: PCT/EP03/13781

§ 371 (c)(1),
(2), (4) Date: Oct. 24, 2005

(87) PCT Pub. No.: WO2004/057238

PCT Pub. Date: Jul. 8, 2004

(65) Prior Publication Data

US 2006/0141920 A1 Jun. 29, 2006

(30) Foreign Application Priority Data

Dec. 19, 2002 (DE) ..... 102 59 758

(51) Int. Cl.
*F24C 15/20* (2006.01)

(52) U.S. Cl. ..... 454/67; 126/299 D; 126/299 R

(58) Field of Classification Search ..... 454/58, 454/60, 56, 67; 126/312, 299 D, 299 E, 299 R, 126/301, 302

See application file for complete search history.

(56) References Cited

U.S. PATENT DOCUMENTS

| | | | | | |
|---|---|---|---|---|---|
| 2,369,375 | A | * | 2/1945 | Sonntag | 55/385.1 |
| 3,098,423 | A | * | 7/1963 | Giannini | 126/299 D |
| 3,233,606 | A | * | 2/1966 | Robert et al. | 126/299 D |
| 3,292,524 | A | * | 12/1966 | Cole | 126/299 D |
| 3,410,195 | A | * | 11/1968 | King | 126/299 E |
| 3,865,022 | A | * | 2/1975 | Ahlrich | 126/299 D |
| 4,040,042 | A | * | 8/1977 | Mayer | 454/340 |
| 4,327,274 | A | * | 4/1982 | White et al. | 219/757 |
| 5,395,410 | A | * | 3/1995 | Jang | 55/471 |
| 5,720,274 | A | | 2/1998 | Brunner et al. | |
| 5,788,565 | A | * | 8/1998 | Chang | 454/67 |
| 5,803,072 | A | | 9/1998 | Strand | |
| 5,927,268 | A | * | 7/1999 | Chiang et al. | 126/299 D |
| 6,001,145 | A | * | 12/1999 | Hammes | 55/471 |

(Continued)

FOREIGN PATENT DOCUMENTS

| | | |
|---|---|---|
| CN | 1041271 | 4/1990 |

(Continued)

*Primary Examiner*—Steven B. McAllister
*Assistant Examiner*—Patrick F. O'Reilly, III
(74) *Attorney, Agent, or Firm*—Russell W. Warnock; James E. Howard

(57) ABSTRACT

An extractor hood housing including at least one ventilator housing which the extractor hood housing forming at least a part of the ventilator housing. The extractor hood housing has at least one section of an external housing wall embodied by a part of the ventilator housing. The ventilator housing for a ventilator device mounted on the extractor hood includes at least one fan. The ventilator housing includes at least one engaging device for engaging a part of the extractor hood.

14 Claims, 3 Drawing Sheets

U.S. PATENT DOCUMENTS

Figure 1:
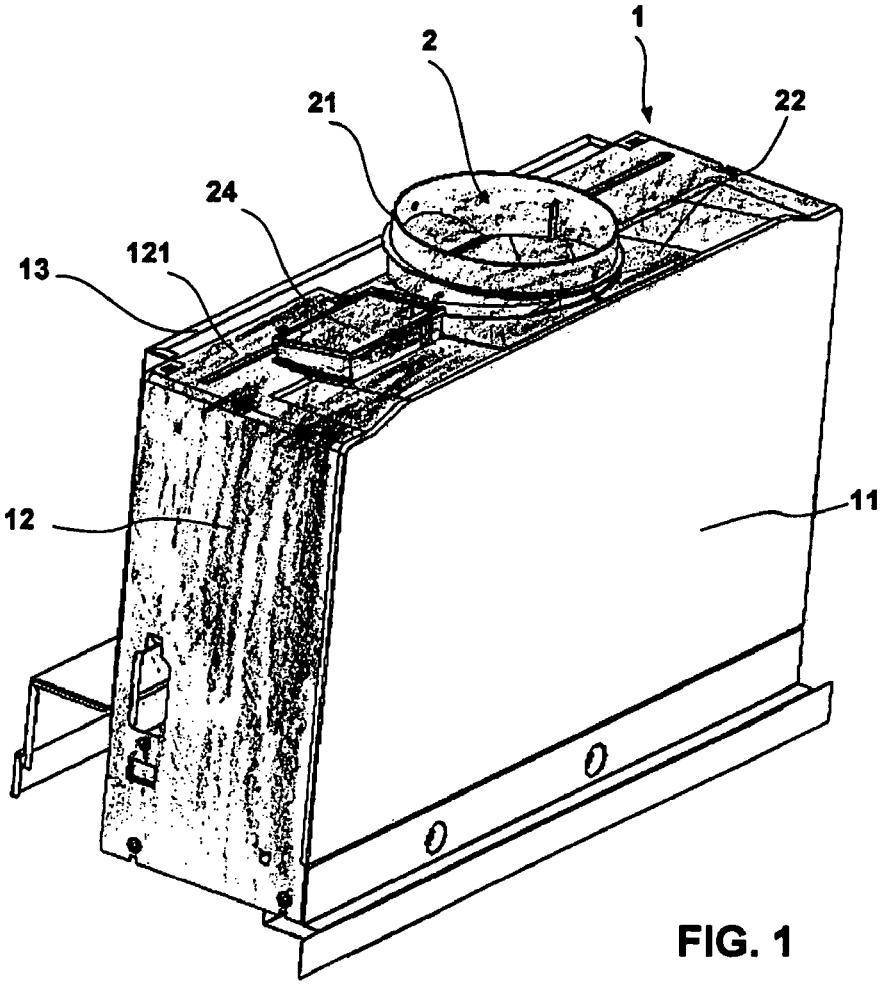

| | | | | |
|---|---|---|---|---|
| 6,142,142 | A | 11/2000 | Woodall, III et al. | |
| 2003/0051725 | A1* | 3/2003 | Man | 126/299 D |
| 2003/0188733 | A1* | 10/2003 | Woodall et al. | 126/299 D |

FOREIGN PATENT DOCUMENTS

| | | | | |
|---|---|---|---|---|
| CN | 2475955 | Y | | 2/2002 |
| DE | 4114329 | A1 | * | 11/1992 |
| DE | 94 16 271 | U | | 4/1995 |
| EP | 1 134 501 | | | 9/2001 |
| JP | 56144344 | A | * | 11/1981 |
| JP | 58213140 | A | * | 12/1983 |
| JP | 06272925 | A | * | 9/1994 |
| WO | PCT/EP2003/013781 | | | 4/2004 |

* cited by examiner

HOUSING FOR AN EXTRACTOR HOOD AND VENTILATOR HOUSING

The present invention relates to a housing for an extractor hood, especially for a flat screen hood, and a ventilator container for a ventilation device of an extractor hood, especially for at least one fan.

In extractor hoods ventilator devices, especially fans are provided to establish a flow in the extractor hood which serves to extract vapour and steam which can be produced for example during cooking. The ventilation devices are accommodated in ventilator containers, especially in ventilator housings, for example, in the form of spiral housings. For this purpose the ventilator container, which can be affixed to a base plate, generally has a suction opening which, in the presence of a base plate, extends through said base plate, and an outlet opening which is provided on the top of the ventilator container in the case of vertically constructed radial fans.

A housing is provided on extractor hoods to guide the vapour and steam to be removed to the suction opening of the ventilator container. This housing together with the base plate, for example, can create a guide channel for the air to be removed to the suction opening of the ventilator container. Furthermore, the housing of the extractor hood generally serves to accommodate the ventilator container to avoid contamination of the container or of lines running to or from the container.

Housings of extractor hoods generally consist of a plurality of individual parts which are joined together by means of screw connections for example. The individual parts of the housing generally comprise a cover, which can have an opening for the outlet opening of the ventilator container, as well as two side walls, a rear wall and a front cover.

The disadvantage of this known structure of housings for extractor hoods is that as a result of the necessary screwing and the large number of individual parts, assembly is difficult and in addition, increased costs are incurred during the manufacture of the individual parts and the assembly.

It is thus the object of the present invention to provide a housing for an extractor hood and a ventilator container for a ventilation device of an extractor hood which can be manufactured simply and inexpensively and allows simple and inexpensive mounting and dismounting of these parts and therefore the extractor hood.

The present invention is based on the knowledge that at least individual parts of the housing of the ventilator container can fulfill several functions.

The object of the present invention is solved according to a first aspect by a housing for an extractor hood, wherein the extractor hood comprises at least one ventilator container and the housing serves as housing for at least part of the ventilator container. The housing is characterised in that one section of an external wall of the housing is formed by a part of the ventilator container.

The ventilator housing in which one or a plurality of fans of an extractor hood are running is designated as the ventilator container in the sense of this invention. Such ventilator containers can thus be, for example, the housing of a radial fan, a spiral fan housing or the like.

The housing of the extractor hood is understood in the sense of this invention as the housing which accommodates the ventilator container at least partly and which therefore serves at least to cover part of the ventilator container and optionally further elements, such as cables for example. The housing can further serve to form the compartment in which the vapour and steam to be removed to a suction opening of the ventilator container is guided. By using a part of the ventilator container as a section of an external wall of the housing, it is not necessary to use a separate housing part for this section. The number of individual parts of the housing and their size can thus be reduced whereby the manufacturing and assembly costs can also be reduced.

The section of the external wall of the housing formed by a part of the ventilator container advantageously forms a section of the top of the housing. The area which needs to be covered by a separate cover of the housing can hereby be minimised and the provision of a separate cover can optionally be completely omitted.

Especially in areas where no further devices are provided on the ventilator container, the ventilator container itself can serve as part of the housing for the extractor hood. Especially in the area around the outlet connecting piece forming the outlet opening of the ventilator container, the outside of the ventilator container can be used as part of the housing. The outlet connecting piece must in any case project out from the housing for the extractor hood for the connection with a waste air pipe or for the inlet into a waste air shaft so that the area around the outlet connecting piece of the ventilator container can simply be used as a section of the top of the housing for the extractor hood.

The part of the ventilator container forming a section of an external wall of the housing advantageously has the form of a plate. In the sense of this invention a part of the ventilator container which has a substantially flat surface is designated as a plate. Using such an area of the ventilator container as part of the housing for an extractor hood can ensure a smooth surface of the housing of the extractor hood which is especially important in relation to the deposition of impurities. The plate is preferably formed in one part with the ventilator container.

According to a preferred embodiment, the housing comprises two side walls and at least one part of one of the side walls forms a section of the top of the housing.

By configuring at least one of the side walls of the housing such that at the same time this forms at least a part of the top of the housing, the area which needs to be covered by a further component on the surface can be reduced.

At least one of the side walls preferably has a bent region at its upper edge. This bent region can be used to form the top of the housing. The bent region is preferably embodied as one part with the side wall. Such a side wall can be manufactured for example by bending. As a result of this simple manufacture of a side wall which at the same time forms a section of the top of the housing, the manufacturing costs can be reduced compared with a housing where the side wall exclusively forms the side of the housing and a cover must be screwed onto the side wall for covering the top.

According to a preferred embodiment, at least a part of the area of the side wall which forms a section of the top of the housing can be brought into engagement with at least one region of the ventilator container. As a result of this engagement, a form-locking connection is preferably achieved between the side wall and the ventilator container. The engagement of the part of the side wall forming a section of the top of the housing, with the ventilator container can be accomplished for example by inserting this part of the side wall into a groove on the ventilator container. The engagement of these two components produces a connection which can make any screwing together of these two components superfluous.

According to a further embodiment, a rear wall of the housing can be brought into engagement with the ventilator container in the area of the top of the housing. In this case, also the engagement is preferably a form-locking connection which makes it possible to fix the rear wall directly on the ventilator container. Screwing the rear wall onto a further part of the housing, for example, the side walls of the housing, can hereby be eliminated. Assembly is thus considerably easier. The engagement of the rear wall with the ventilator container can be accomplished, for example, by means of a bent region provided at the rear wall. This bent region can be embodied, for example, in the form of a flange.

According to a further aspect of the invention, the object forming the basis of the invention is solved by a ventilator container for a ventilation device of an extractor hood, especially for at least one fan, wherein this has at least one engaging device for a part of the housing for the extractor hood. A simple type of fixing of the housing parts is provided by providing engaging devices for housing parts. In this case, the engaging device preferably comprises at least one receiving area for a part of a side wall and/or rear wall of the housing.

The ventilator container preferably has at least one plate-shaped area on its top. This plate-shaped area can be used as a section of the external wall of the housing for the extractor hood. At the same time, the plate-shaped area can constitute at least one part of the engaging device for further housing parts. The plate-shaped area on the ventilator container is preferably configured so that it extends from the outlet connecting piece of the ventilator container over at least part of the width and depth of the housing for the extractor hood. This plate-shaped area can thus form at least a section of the top of the housing and is embodied in one part with the ventilator container, which facilitates assembly.

The features and advantages of the housing apply accordingly and as far as is applicable to the ventilator container.

Figure 2:
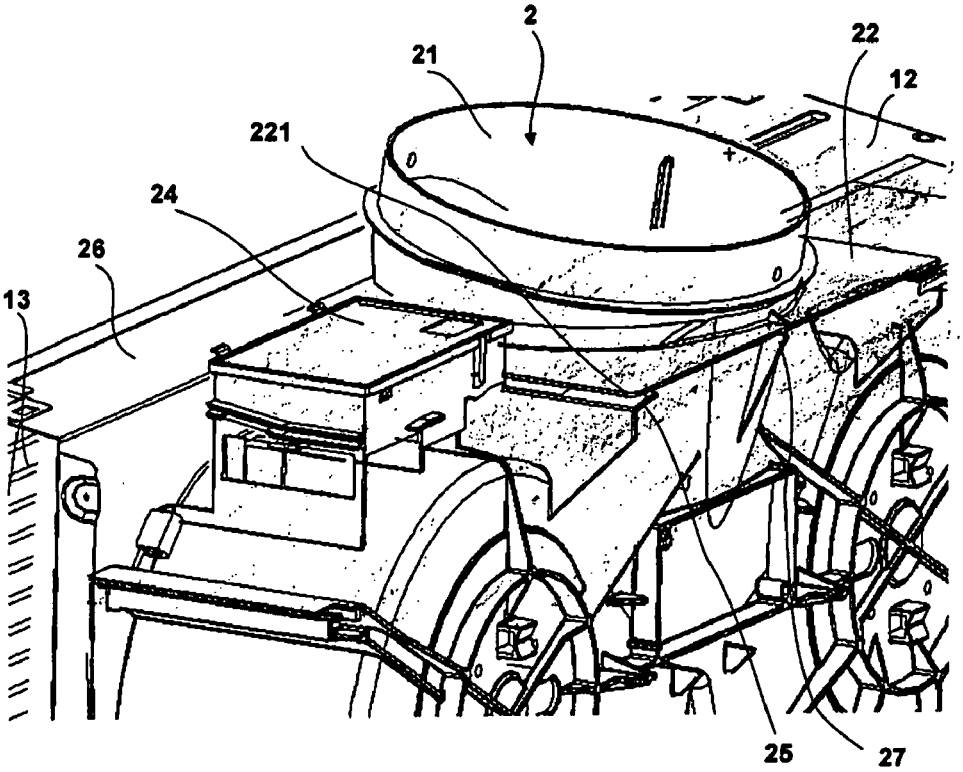
Figure 2A:
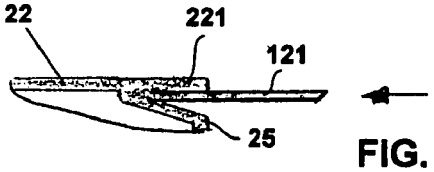
Figure 3:
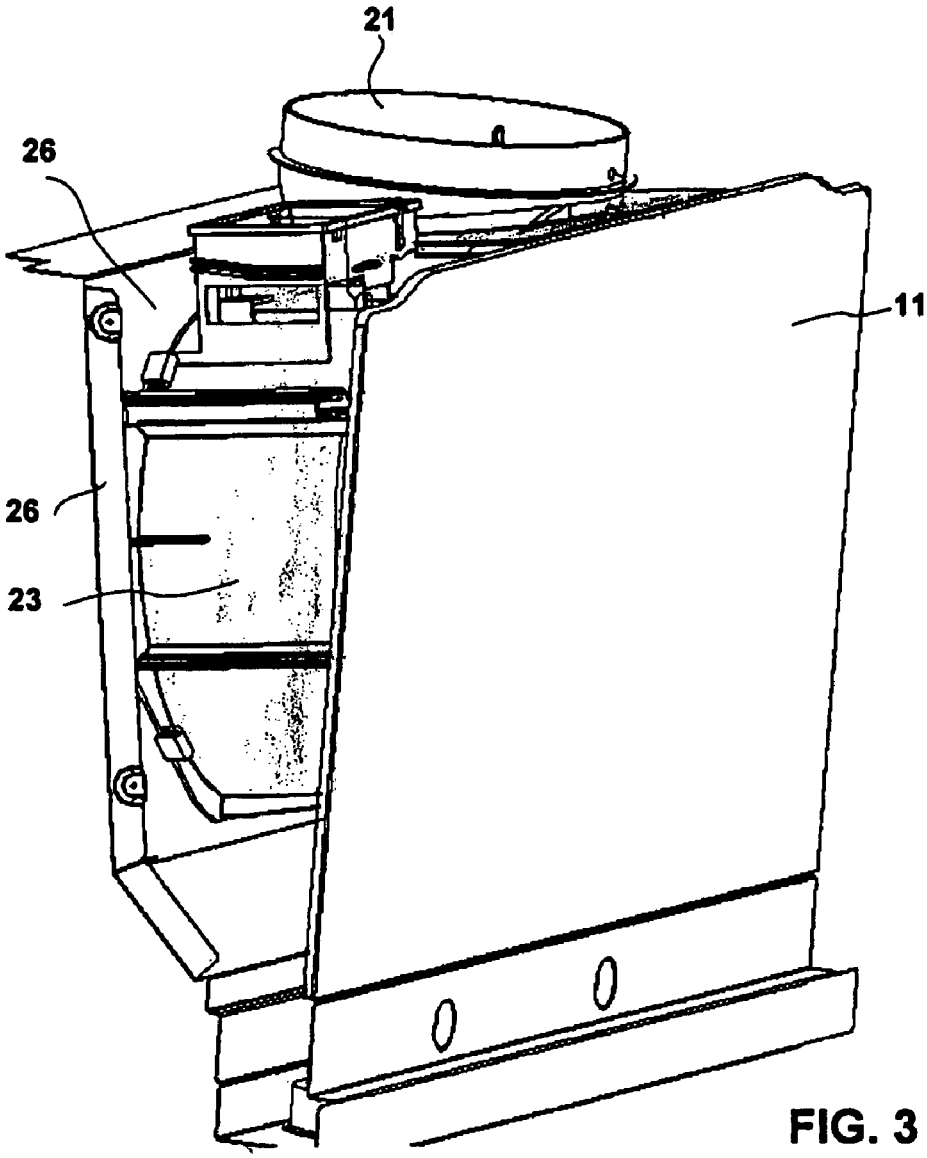
Figure 3A:
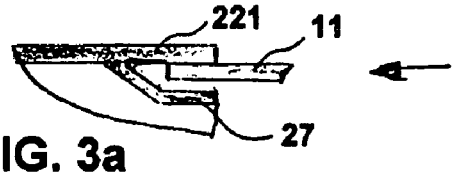

The present invention is described in further detail subsequently with reference to the appended drawings, wherein:

FIG. 1: shows a perspective view of a housing according to the invention shown from behind, FIG. 2: shows a perspective view of a ventilator container according to the invention with a side wall of the housing, FIG. 2*a*: shows a detailed view of the connection of the side wall and the ventilator container, FIG. 3: shows a perspective view of a ventilator container with a rear wall, FIG. 3*a*: shows a detailed view of the connection of the rear wall with the ventilator container.

The embodiment of the housing for an extractor hood according to the invention shown in FIG. 1 comprises a rear wall 11, a front cover 13 and two side walls 12. The side walls 12 extend over the total height of the housing 1 and each have a bent area 121 at the upper edge. In the embodiment shown these bent areas 121 form a section of the top of the housing. The further section of the top of the housing 1 is formed by a part 22 of a ventilator container 2 which is accommodated in the housing 1. In the bent area 121 of the side wall 12, gaps can be provided which, as shown in FIG. 1 can serve as the opening for components. In the embodiment shown the gap serves, for example, as the opening for a receptacle 24 for the mains connection of the ventilation device. This receptacle 24 is thus accessible outside the housing 1 without needing to dismantle parts of the housing 1. The plate-shaped area 22 of a ventilator container 2 which is described in more detail later with reference to FIGS. 2 and 3 extends over the depth of the housing as far as the rear wall 11 of the housing 1. Over the width the plate-shaped area 22 extends from the edge of the bent region 121 of one side wall as far as the edge of the bent region 121 of the second side wall 12. In the bent region 121 of the side wall 12, which extends on the top of the housing 1, the width of the side wall is designed so that this extends from the rear wall 11 to the front cover 13.

FIG. 2 shows a ventilator container 2 according to the invention with a front cover 13 and one of the side walls 12. As can be seen from this figure, the region 22 extends in the form of a flat plate around the outlet connecting piece 21 of the ventilator container 2. On the underside of the plate-shaped region 22 the further container wall of the ventilator container 2 continues at a distance from the edge 221 of the plate-shaped region 22. The edge 221 of the plate-shaped region 22 hereby projects over the container wall 25 which goes over into the container regions 23 for accommodating the ventilator, and a groove is formed. In the embodiment shown as can especially be seen from FIG. 2*a*, the container wall 25 is arranged at an angle to the plate-shaped region 22. However, it is also within the scope of the invention to initially construct the container wall 25 perpendicular to the plate-shaped region 22 and then make it run parallel to the plate-shaped region 22. The groove formed between the container wall 25 and the edge 221 of the plate-shaped region 22 forms a receiving area for the edge of the side wall 12. The side wall 12, especially the bent region 121, can be connected to the ventilator container 2 by inserting in the direction indicated by an arrow in FIG. 2*a*. In addition to this connection by engaging in the groove on the ventilator container 2, the side can additionally be connected to the ventilator container 2 by locating devices. For example, lugs (not shown) can be provided on the edge of the side wall, which can cooperate with openings (not shown) in the area of the edge 221 of the plate-shaped region 22.

As is further deduced from FIG. 2, a projection 27 is provided underneath the plate-shaped region 22 on the ventilator housing 2, which extends in the form of a strip perpendicular to the ventilator container 2 and is directed towards the rear wall 11 which is not shown in FIG. 2.

A gap into which a part of the rear wall 11 can be inserted is formed between the upper edge of this projection 27 and the underside of the plate-shaped region 22. The part of the rear wall 11 which cooperates with the gap between the edge 221 and the projection 27 can, for example, be a flange which can be provided on the rear wall 11, at least in the area of the projection 27.

Alternatively, a longitudinal groove, for example, underneath the edge 221 of the plate-shaped region 22, can also be provided as an engaging device for the rear wall 11 on the ventilator container 2, which allows engagement of a flange or another projection of the rear wall 11.

As can be seen from FIGS. 2 and 3, the space for guiding the vapour and steam to the suction openings of the fan container 2 is defined at the front by the front plate 13 and is defined at the top and towards the ventilator container 2 by a base plate 26.

The present invention is not restricted to the embodiment shown. It is also within the scope of the invention to configure the side walls of the housing so that they extend over a larger area of the top of the housing than that shown in the figures. The bent regions of the side walls can, for example, extend as far as the outlet connecting piece of the ventilator container. In this case, a groove can be provided on the outlet connecting piece into which the edge of the side wall can engage, which in this embodiment then has a corresponding gap for the outlet connecting piece.

Alternatively it is likewise possible to configure the ventilator container so that a plate-shaped region extends substantially over the entire width of the housing from the outlet connecting piece of the ventilator container. Side walls having the form of a flat wall and merely comprising a narrow flange at the upper edge can then be connected to this broad plate-shaped region.

The engaging means for engagement of the housing parts with the ventilator container are not restricted to the designs shown. It is also possible to provide a groove at the edges of the bent areas of the side walls into which a plate-shaped region of the ventilator container can engage for example. Likewise, a groove can be provided on the rear wall which can cooperate with a plate-shaped region in the same way. In addition to or alternatively to providing grooves for inserting parts, locating devices can be provided at the connecting points between the ventilator container and side wall or rear wall, for example, in the form of lugs and openings or clips.

Thus, especially when integrating parts of the cover into the ventilator container, the present invention only requires two side walls which form the cover together with the ventilator container. Thus, the provision of a separate cover part can be omitted. Screwing side parts to a cover is also no longer necessary. The present invention therefore considerably reduces the assembly time for the housing of the extractor hood and therefore the entire extractor hood. The number of parts required to assemble the housing is furthermore reduced since a separate cover part can be omitted. Finally, screws are saved since these can be superfluous for connecting the side walls to the ventilator housing to form the top and for connecting the side sections to the rear wall.

The invention claimed is:

1. A housing for an extractor hood, comprising:

at least one ventilator container for containing therein a ventilator device operable to impart motion to steam and other gaseous fluid wherein the housing serves as a housing for at least part of said ventilator container and the housing is operable for receiving and guiding steam and other gaseous fluid to said ventilator container with said ventilator container being disposed at least partly in said housing and a portion of said ventilator container forming one section of an external wall of said housing; and two generally L-shaped side walls with each of said side walls having a bent region and an upper edge, said L-shaped side walls being removably attached to said one section of the external wall of said housing and spaced apart by a portion of said ventilator container and wherein said bent region of each said side wall forms a section of the top of said housing and is in engagement with at least one region of said ventilator container via a form-locking connection.

2. The housing according to claim 1, including said section of said external wall of said housing formed by said portion of said ventilator container forms a top section of said housing.

3. The housing according to claim 1, including said portion of said ventilator container forming said section of said external wall of said housing is located in the area of an outlet connecting piece of said ventilator container.

4. The housing according to claim 1, including said portion of said ventilator container forming said section of said external wall of said housing has the form of a plate.

5. The housing according to claim 1, including said housing includes two side walls and at least one part of one of said side walls forms a section of the top of said housing.

6. The housing according to claim 5, including a part of an area of said side wall which forms said section of said top of said housing is in engagement with at least one region of said ventilator container and at least one of said side walls has a bent region at its upper edge.

7. The housing according to claim 1, including said housing includes a pair of housing walls each of which has a peripheral edge defining the extent of the respective housing wall in one selected direction and the peripheral edges of the pair of housing walls being spaced from one another and said ventilator container has an exterior forming portion that extends at least partially between the pair of housing walls and that is inwardly of the peripheral edges of the pair of housing walls, said exterior forming portion of said ventilator container forming said one section of an external wall of said housing.

8. The housing according to claim 7, including said one ventilator container contains a ventilator device in the form of a fan operable to impart motion to steam and other gaseous fluid.

9. The housing according to claim 7, including at least one of said housing walls includes a projecting edge for engagement with said exterior forming portion of said ventilator container.

10. The housing according to claim 1, including said form-locking connection is formed entirely by said bent region of said side wall and said at least one region of said ventilator container.

11. The housing according to claim 1, including said form-locking connection is a groove formed on at a selected one of said bent region of said side wall and said at least one region of said ventilator container with the other of said bent region of said side wall and said at least one region of said ventilator container being secured to the selected one of said bent region of said side wall and said at least one region of said ventilator container having said groove via insertion of an edge thereof into said groove.

12. The housing according to claim 11, including said form-locking connection is a groove formed on said at least one region of said ventilator container and said bent region of said side wall is secured to said at least one region of said ventilator container having said groove via insertion of an edge of said bent region of said side wall into said groove formed on said at least one region of said ventilator container.

13. The housing according to claim 11, including said at least one region of said ventilator container includes a container wall and a plate-shaped area having an edge with said edge of said plate-shaped area extending over said container wall to thereby form said groove and said bent region of said side wall is secured to said at least one region of said ventilator container having said groove via insertion of said bent region of said side wall below said edge of said plate-shaped area of said at least one region of said ventilator container.

14. A housing for an extractor hood, comprising:

at least one ventilator container for containing therein a ventilator device operable to impart motion to steam and other gaseous fluid wherein the housing serves as a housing for at least part of said ventilator container and the housing is operable for receiving and guiding steam and other gaseous fluid to said ventilator container with said ventilator container being disposed at least partly in said housing and a portion of said ventilator container forming one section of an external wall of said housing; and two side walls, at least one of said side walls having a bent region at its upper edge, said bent region of said side wall forming a section of the top of said housing and said bent region of each said side wall being in engagement with at least one region of said ventilator container, wherein said ventilator container includes a form-locking connection including a body having a recess formed therein for receiving said bent region of said side wall, said body including at least two body portions extending away from said recess to define a receiving area for said bent regions of said side walls.

* * * * *